US008245482B2

(12) United States Patent
Grubka et al.

(10) Patent No.: US 8,245,482 B2
(45) Date of Patent: Aug. 21, 2012

(54) METHOD OF ATTACHING CAP SHINGLES ON A ROOF RIDGE

(75) Inventors: Lawrence J. Grubka, Westerville, OH (US); Jennifer L. Frey, Monclova, OH (US); Brian Ray, Whitehouse, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 75 days.

(21) Appl. No.: 12/814,268

(22) Filed: Jun. 11, 2010

(65) Prior Publication Data

US 2011/0302852 A1 Dec. 15, 2011

Related U.S. Application Data

(60) Provisional application No. 61/185,630, filed on Jun. 10, 2009.

(51) Int. Cl.
*E04D 13/17* (2006.01)
*F24F 7/02* (2006.01)

(52) U.S. Cl. ..... 52/748.1; 52/199; 454/365

(58) Field of Classification Search ..... 52/198, 52/553, 518, 530, 531, 532, 533, 534, 538, 52/542, 545, 748.1, 199, 443; 454/365
See application file for complete search history.

(56) References Cited

U.S. PATENT DOCUMENTS 4,280,399 A * 7/1981 Cunning ..... 454/365
4,404,783 A 9/1983 Freiborg
4,835,929 A * 6/1989 Bondoc et al. ..... 52/518
4,907,499 A * 3/1990 James ..... 454/365
4,957,037 A * 9/1990 Tubbesing et al. ..... 454/366
5,052,286 A * 10/1991 Tubbesing et al. ..... 454/365
5,095,810 A * 3/1992 Robinson ..... 454/365
5,122,095 A * 6/1992 Wolfert ..... 454/365
5,331,783 A * 7/1994 Kasner et al. ..... 52/199
5,772,502 A * 6/1998 Smith ..... 454/365
6,125,602 A * 10/2000 Freiborg et al. ..... 52/560
6,149,517 A * 11/2000 Hansen ..... 454/365
6,227,963 B1 * 5/2001 Headrick ..... 454/365
6,233,887 B1 * 5/2001 Smith ..... 52/199
6,260,315 B1 * 7/2001 Smith ..... 52/199
6,277,024 B1 * 8/2001 Coulton ..... 454/365
6,371,847 B2 * 4/2002 Headrick ..... 454/365
6,782,671 B2 8/2004 Timbrel et al.
6,793,574 B1 * 9/2004 Robinson ..... 454/365
6,902,476 B2 6/2005 Rotter
6,991,535 B2 1/2006 Ciepliski et al.
7,024,828 B2 * 4/2006 Headrick ..... 52/198
7,182,688 B2 2/2007 Coulton
7,384,331 B2 6/2008 Coulton
7,393,273 B2 7/2008 Ehrman et al.
7,422,520 B2 9/2008 Coulton et al.
7,537,518 B2 * 5/2009 Villela et al. ..... 454/365
(Continued)

*Primary Examiner* — Robert Canfield
(74) *Attorney, Agent, or Firm* — MacMillan, Sobanski & Todd, LLC

(57) ABSTRACT

A method of attaching a cap shingle on a roof ridge line structure includes providing a plurality of risers configured to be flexed for alignment with the opposed roof planes, flexing and positioning the risers over the ridge line structure, and installing a series of the risers in an partially overlapping manner along the ridge line structure by fastening the risers to opposed roof planes. Cap shingles configured for attachment to the risers are flexed and attached to the risers. A roof structure installed according to the method is also provided. A ridge line roofing assembly comprising a series of partially overlapping risers molded together is also provided.

9 Claims, 6 Drawing Sheets

U.S. PATENT DOCUMENTS

| | | | | |
|---|---|---|---|---|
| 7,662,037 | B2 * | 2/2010 | Polston | 454/365 |
| D615,218 | S * | 5/2010 | Grubka et al. | D25/141 |
| 7,765,763 | B2 * | 8/2010 | Teng et al. | 52/518 |
| D628,718 | S * | 12/2010 | Grubka et al. | D25/141 |
| 8,069,621 | B2 * | 12/2011 | Mantyla et al. | 52/198 |
| 2002/0078651 | A1 * | 6/2002 | Freshwater et al. | 52/553 |
| 2002/0100232 | A1 * | 8/2002 | Robinson et al. | 52/198 |
| 2004/0088928 | A1 * | 5/2004 | Headrick et al. | 52/98 |
| 2006/0079173 | A1 | 4/2006 | Coulton et al. | |
| 2007/0054612 | A1 | 3/2007 | Ehrman et al. | |
| 2008/0034685 | A1 | 2/2008 | Ogletree | |
| 2008/0064320 | A1 * | 3/2008 | Polston | 454/365 |
| 2008/0287054 | A1 * | 11/2008 | Carlson et al. | 454/365 |
| 2010/0112932 | A1 * | 5/2010 | Grubka et al. | 454/365 |

* cited by examiner

METHOD OF ATTACHING CAP SHINGLES ON A ROOF RIDGE

This application claims priority from U.S. Provisional Patent Application Ser. No. 61/185,630, filed Jun. 10, 2009, and entitled METHOD OF ATTACHING A CAP SHINGLE TO A RISER.

BACKGROUND OF THE INVENTION

Buildings, such as for example residential buildings, may be covered by a sloped roof. The interior portion of the building located directly below the sloped roof can form a space called an attic. If unventilated, condensation can form on the interior surfaces within the attic. The condensation can cause damage to various building components within the attic, including, but not limited to the insulation, as well as potentially causing damage to the building structure of the attic. Accordingly, it is known to ventilate attics thereby helping to prevent the formation of condensation. One example of a method of ventilating an attic includes the positioning of vents over elongated openings formed at the intersection of roof planes. The opening can allow hot air within the attic to escape the attic through the vents.

Vents can be installed using various methods including placing discrete vent sections end-to-end over the opening or unrolling a continuous vent over the opening. In the event discrete vent sections are used, the discrete sections of the vents can be flexed to conform to the shape of the sloping roof planes and attached to the roof planes via roof nails. Portions of the vents can be subsequently covered by shingles. The shingles can have an appearance that is the same as or complimentary to the roofing shingles used on other portions of the roof.

It would be advantageous if the cap shingles were easier to install and capable of being installed in a more aesthetically pleasing manner.

SUMMARY OF THE INVENTION

According to this invention there is provided a method of attaching a cap shingle on a roof ridge line structure, the ridge line structure being defined by opposed roof planes. The method includes providing a plurality of risers, positioning the risers over the ridge line structure, and installing a series of the risers in an partially overlapping manner along the ridge line structure by fastening the risers to the opposed roof planes. Cap shingles configured for attachment to the risers are attached to the risers.

In one embodiment the installing of the risers and attachment of the shingles is carried out by placing a riser on the ridge line structure, placing a cap shingle on the riser, and fastening the cap shingle and the riser to the ridge line structure with a fastener.

In another embodiment, the installing of the risers and attachment of the shingles is carried out by attaching the cap shingle to a riser, and then fastening the riser to the ridge line structure with a fastener.

In yet another embodiment, the cap shingles have headlap portions and prime portions, and the step of installing the risers in a partially overlapping manner includes covering a headlap portion of a previously installed cap shingle.

In another embodiment the risers are configured to be flexed for alignment with the opposed roof planes, and the risers are flexed before being installed on the roof, and further including flexing the cap shingles to conform to the flexed shape of the risers.

According to this invention there is also provided a roof structure including a roof ridge line structure, the ridge line structure being defined by opposed roof planes, a series of risers positioned along the ridge line structure in a partially overlapping manner, and cap shingles attached to the risers, the cap shingles having headlap portions and prime portions, the risers and cap shingles being installed so that a riser will cover the headlap portion of a previously installed shingle, with the cap shingles being attached to the risers and the risers being fastened to the ridge line structure.

According to this invention, there is also provided a roofing assembly for a ridge line structure comprising a series of partially overlapping risers, the risers being bonded together into the assembly so that the assembly can be installed on a ridge line structure of a roof, the risers being attached to each other in a manner defining slots beneath the overlapping portions of the risers, the slots being configured to receive a headlap portion of a cap shingle when the ridge line structure roofing assembly is positioned on a ridge line structure of a roof.

Various advantages of this invention will become apparent to those skilled in the art from the following detailed description of the invention, when read in light of the accompanying drawings.

DETAILED DESCRIPTION OF THE INVENTION

The present invention will now be described with occasional reference to the specific embodiments of the invention.

This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

In accordance with embodiments of the present invention, methods of attaching a cap shingle to a riser are provided. It will be understood the term "hip" refers to the inclined external angle formed by the intersection of two sloping roof planes. The term "ridge" refers to the intersection of the uppermost sloping roof planes. The term "roof plane" is defined to mean the plane defined by a roof surface. The term "slope" is defined to mean the degree of roof incline expressed as a ratio of the rise in inches to the run of roof. The term "cap shingle" are used herein, is defined to mean a shingle applied to a vent or structure applied over a hip or ridge. The term "riser" as used herein, is defined to mean any structure to which a cap shingle is attached.

Figure 1:
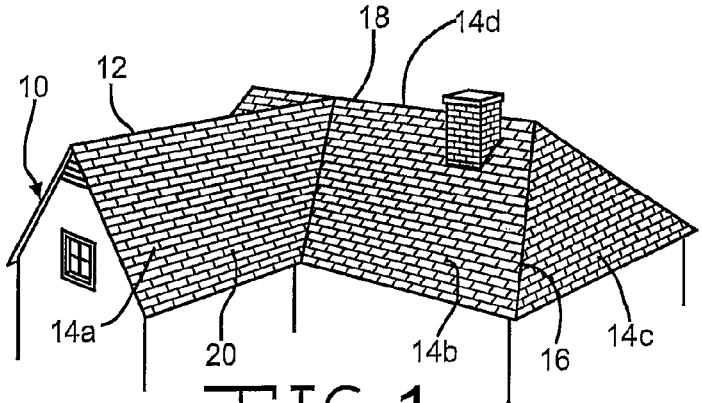
FIG. 1 is a perspective view of a building structure illustrating a ridge formed by the intersection of the uppermost sloping roof planes and a hip formed by the intersection of other sloping planes.

The description and figures disclose methods of attaching a cap shingle to a riser for a roofing system. Referring now to FIG. 1, a building structure 10 is shown having a shingle-based roofing system 12. While the building structure 10 illustrated in FIG. 1 is a residential home, it should be understood that the building structure 10 can be any type of structure, such as a garage, church, arena, industrial or commercial building, having a shingle-based roofing system 12.

The building structure 10 has a plurality of roof planes 14*a*-14*d*. Each of the roof planes 14*a*-14*d* can have a slope. While the roof planes 14*a*-14*d* shown in FIG. 1 have their respective illustrated slopes, it should be understood that the roof planes 14*a*-14*d* can have any suitable slope. The intersection of the roof planes 14*b* and 14*c* form a hip 16. Similarly, the intersection of the roof planes 14*b* and 14*d* form a ridge 18. The building structure 10 is covered by the roofing system 12 having a plurality of shingles 20. The shingles 20 can be any desired shingle and can be installed on the various roof planes, 14*a*-14*d*, in any desired pattern.

Figure 4:
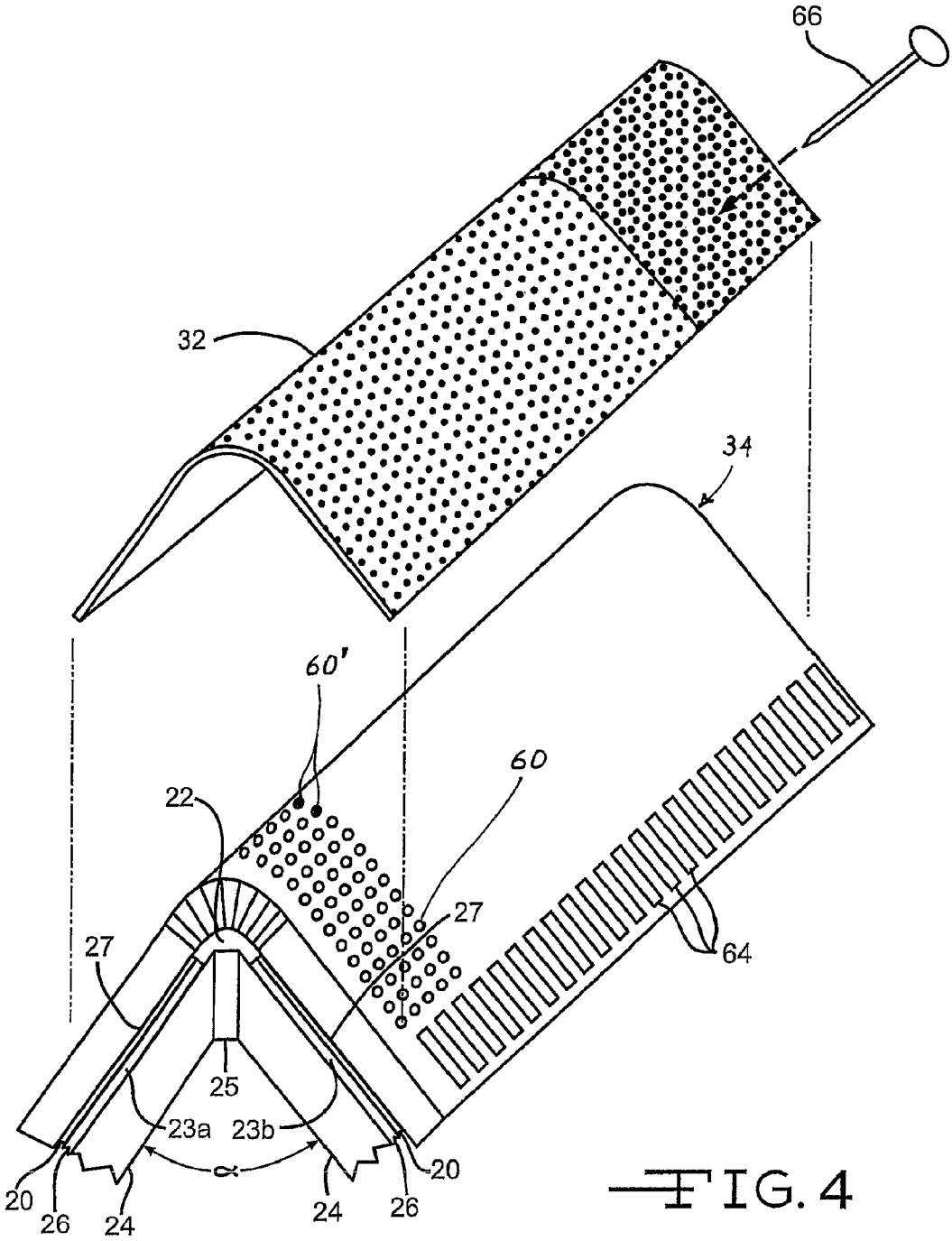
FIG. 4 is a perspective view of a first embodiment of a method of installing the cap shingle of FIG. 2 over the riser of FIG. 3.

Referring now to FIG. 4, a ridge opening 22 can be formed between opposed first and second roof planes, 23*a* and 23*b*, and optionally can be configured to allow a flow of air to travel through an attic and exit through the ridge opening 22. While the illustrated embodiment is described below for a ridge, it should be appreciated that the description is appropriate for a hip. For purposes of this specification, the term "ridge line structure" includes roof ridges, hips and similar structures. Each of the first and second roof planes, 23*a* and 23*b*, is formed by a series of generally parallel, spaced apart rafters 24 (for purposes of clarity, only one rafter 24 is shown for each of the roof planes, 23*a* and 23*b*). In the illustrated embodiment, the rafters 24 are connected at one end to a ridge board 25 and at the other end to a wall (not shown). In other embodiments, the ends of the rafters 24 can be connected to other desired components or structures. In the illustrated embodiment, the rafters 24 and the ridge board 25 are made from framing lumber, having sizes including, but not limited to 2 inches thick by 10 inches wide. Alternatively, the rafters 24 and the ridge board 25 can be made from other desired materials and have other desired sizes.

As shown in FIG. 4, the first and second roof planes, 23*a* and 23*b*, intersect with the ridge board 25 thereby forming slope angle $\alpha$. In one embodiment, the slope angle $\alpha$ may be approximately 120°. Alternatively, the slope angle $\alpha$ can be more or less than approximately 120°.

Referring again to FIG. 4, the rafters 24 are covered by sheathing 26. The sheathing 26 is configured to form an upper surface 27 of the roof planes, 23*a* and 23*b*. In the illustrated embodiment, the sheathing 26 is made of a wood-based material, including, but not limited to oriented strand board or plywood. In other embodiments, the sheathing 26 can be other desired materials.

The upper surface 27 of the roof planes, 23*a* and 23*b*, supports a plurality of shingles 20. The shingles 20 are attached to the upper surface 27 of the sheathing 26 by using any desired fasteners, including, but not limited to roofing nails (not shown). It should be understood that the shingles 20 can be any desired roofing material.

While the ridge opening 22 shown in FIG. 4 is formed by the structure of the rafters 24, ridge board 25 and roof planes, 23*a* and 23*b*, it should be understood the ridge opening 22 can be formed by other structures or combinations of structures. Also, it is to be understood that the ridge line structure can be formed with no opening 22, with the first and second roofing planes 23*a*, 23*b* meeting at the ridge line.

Referring again to FIG. 4, an exemplary method of attaching a cap shingle 32 to a riser 34 is illustrated. Generally, the cap shingle 32 is attached to the riser 34 after the riser 34 has been installed over the ridge or ridge opening 22. In the illustrated embodiment, the riser 34 is configured as a ridge vent configured to span the opening 22 in the ridge 18 and allow a flow of air to travel through the attic and exit through the riser 34. In other embodiments, the riser 34 can be other structures configured to span ridge line or hip line of roof. In these alternate embodiments, the riser 34 can be configured to allow any amount of air to travel through the attic and exit through the riser 34, or, in the alternative, can be configured to cover a ridge or hip with no provision for air flow. It is to be understood that the riser 34 can be configured so that is does not act as a ridge vent.

Figure 2:
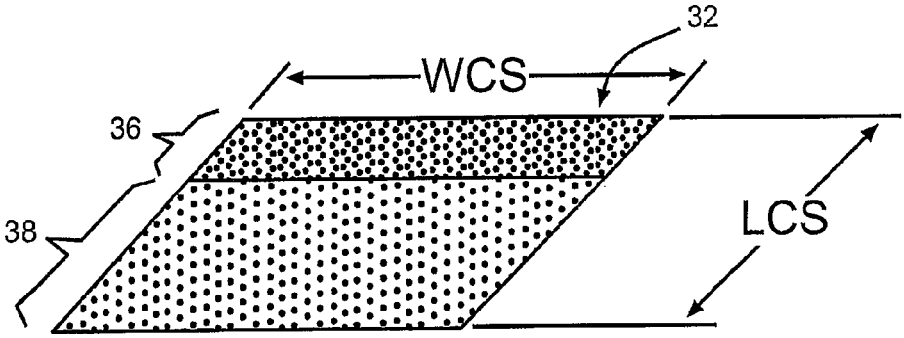
FIG. 2 is a perspective view of a cap shingle in accordance with a first embodiment of the invention.

Referring now to FIG. 2, an exemplary cap shingle 32 is illustrated. The cap shingle 32 can be any desired shingle, including but not limited to asphalt-based shingles or nonasphalt-based shingles. The cap shingle 32 can have any desired granules applied to any portion of its upper surface. Alternatively, the cap shingle 32 can be a granules cap shingle 32. The cap shingle 32 can have any type of substrate (not shown) or the cap shingle can be formed without a substrate. The cap shingle 32 can have any desired combination of layers, coatings or aesthetic finishes. The cap shingle 32 can have any desired thickness.

In the illustrated embodiment, the cap shingle 32 includes a headlap region 36 and a prime region 38. The headlap region 36 is the portion of the cap shingle 32 that is covered by successive overlapping risers 34 when the risers 34 and cap shingles 32 are installed over the ridge 18. The prime region 38 is the portion of the cap shingle 32 that remains exposed when the risers 34 and the cap shingles 32 are installed over the ridge 18. The cap shingle 32 can have any proportion of headlap region 36 to prime region 38. In other embodiments, the cap shingle can have only a prime region 38 and no headlap region 36.

The cap shingle 32 has a width WCS and a length LCS. The width WCS and the length LCS of the cap shingle will be discussed in more detail below.

The riser 34 can have any desired design sufficient to span the ridge 18 and allow a flow of air to travel through the attic and exit through the riser 34. As discussed above, in the illustrated embodiment the riser 34 is a ridge vent. Once positioned on a roof, the riser 34 functions in an outdoor environment, with all of the elements of the weather. Accordingly, the riser 34 can be made of any desired material sufficient to provide both structural and weatherability features. In the illustrated embodiment, the riser 34 is made of a polypropylene material. Alternatively, the riser 34 can be made of other materials, including but not limited to polymeric materials or combinations of materials, sufficient to provide both structural and weatherability features.

The riser 34 has a width WR, a length LR and a thickness TR. In the illustrated embodiment, the width WR of the riser 34 is approximately 14.0 inches, the length LR of the riser 34 is approximately 12.0 inches and the thickness TR is approximately 1.0 inch. Alternatively, the width WR, length LR and thickness TR of the riser can be any desired dimensions. Prior to flexing, the riser has a rectangular shape in a plan view, although in other embodiments the riser can have other shapes.

Figure 3:
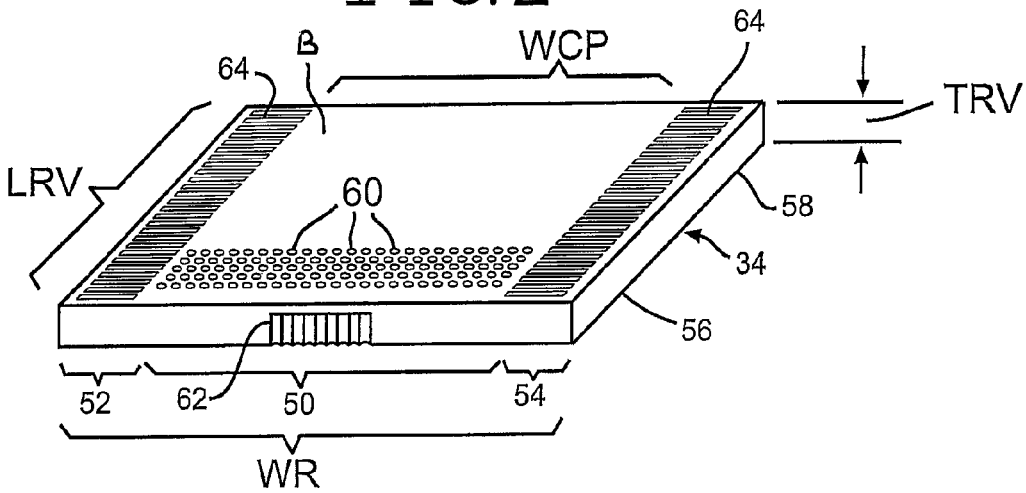
FIG. 3 is a perspective view of a riser in accordance with a first embodiment of the invention

Referring now to FIG. 3, the riser 34 has a broad face B defining a center portion 50, opposed side portions, 52 and 54, a first end 56 and a second end 58. The center portion 50 optionally includes a plurality of apertures 60 positioned at the first end 56. In the illustrated embodiment, the apertures 60 are arranged in rows and columns. Alternatively, the apertures 60 can be arranged in any desired pattern. In the illustrated embodiment, the apertures 60 have a circular cross-sectional shape. Alternatively, the apertures 60 can have any desired cross-sectional shape. The apertures 60 will be discussed in more detail below.

The center portion 50 has a width WCP. In the illustrated embodiment, the width WCP of the center portion 50 is approximately 12.0 inches. In other embodiments, the width WCP of the center portion 50 can be other desired dimensions.

The center portion 50 optionally includes a sealing web 62. The sealing web 62 can optionally be positioned at both the first end 56 and the second end 58 of the center portion 50. The sealing web 62 is configured to compress the folds of the sealing web 62 against each other as the center portion 50 of the riser 34 is flexed, thereby effectively sealing the end of the center portion 50 of the riser 34. The sealing web 62 can have any desired design or configuration.

As shown in FIG. 3, the opposed side portions, 52 and 54, have a plurality of louvers 64 formed in the broad face B. The louvers 64 are configured such that a flow of air can exit the attic through the louvers 64. In the illustrated embodiment, the louvers 64 are arranged in a single column and extend substantially along the length LR of the riser 34. In other embodiments, the louvers 64 can be arranged in other desired configurations, including but not limited to multiple columns or rows having a non-columnar alignment. It is to be understood that the louvers in the risers are optional.

Referring again to FIG. 3, the louvers 64 have a rectangular shape. In other embodiments, the louvers 64 can have other desired shapes, including, but not limited to round or hexagonal shapes, sufficient to allow the flow of air to exit the riser 34 through the louvers 64.

As discussed above, the cap shingle 32 has a width WCS and a length LCS. Generally, the width WCS and a length LCS of the cap shingle 32 correspond to the width WCP of the center portion 50 and the length LR of the riser 34. In one embodiment, the width WCS of the cap shingle 32 and the width WCP of the center portion 50 of the riser 34 are approximately 12.0 inches and the length LCS of the cap shingle 32 and the length LR of the riser 34 are approximately 12.0 inches. In other embodiments, the width WCS of the cap shingle 32 can be any desired dimension sufficient to allow the flow of air to exit the riser 34 through the louvers 64 and the length of the cap shingle 32 can be any desired dimension.

Referring again to FIG. 4 and as discussed above, an initial riser 34 is positioned over the ridge opening 22 and fastened to the roof planes, 23*a* and 23*b*, prior to attaching the cap shingle 32 to the initial riser 34. The initial riser 34 is installed in a flexed position thereby allowing the bottom surfaces of the riser to seat against the roof planes, 23*a* and 23*b*. The riser 34 can be flexed to any desired degree sufficient to allow the bottom surfaces of the riser 34 to seat against the roof planes, 23*a* and 23*b*. Optionally, the center portion 50 of the riser 34 can include any structure that facilitates the flexing of the riser, including but not limited to a plurality of grooves extending the length LR of the riser 34. In the illustrated embodiment, the initial riser 34 is fastened to the roof planes, 23*a* and 23*b*, with roofing nails. In other embodiments, the initial riser 34 can be attached to the roof planes, 23*a* and 23*b*, in any desired manner.

As shown in FIG. 4, after the initial riser 34 has be positioned over the ridge opening 22 and fastened to the roof planes, 23*a* and 23*b*, the cap shingle 32 is attached to the riser 34. In the illustrated embodiment, the cap shingle 32 is attached to the initial riser 34 with the following steps. First, an adhesive (not shown) is applied to a rear surface (not shown) of the cap shingle 32. The adhesive can be any desired adhesive, including but not limited to a modified sealant adhesive (MSA). The adhesive can be applied to the rear surface in any desired manner, including non-limiting examples such as beads, dots or non-continuous segments. In the illustrated embodiment, the adhesive is applied to a rear surface area of the cap shingle 32 that generally corresponds to the area of the apertures 60 in the riser 34. Alternatively, the adhesive can be applied to any desired rear surface area of the cap shingle 32. The cap shingle 32 is flexed and aligned with the center portion 50 of the initial riser 34. The cap shingle 32 is brought into contact with the initial riser 34 thereby allowing the adhesive on the rear surface of the cap shingle 32 to partially flow through the apertures 60 in the center portion 50 of the initial riser 34, as shown at the apertures 60' in FIG. 4. In FIG. 4, only two representative apertures 60' are shown having adhesive within the apertures 60'. It will be understood that adhesive that has been applied to the rear surface area of the cap shingle 32 as described above may flow through any of the apertures 60. As shown in FIG. 4, the adhesive attaches the cap shingle 32 to the initial riser 34. Subsequently, the riser 34 and cap shingle 32 are attached to the roof using a nail 66 or any other suitable fastener. Successive risers 34 and cap shingles 32 are installed as described in more detail below. Although the riser 34 is shown having the apertures 60 for enhanced bonding of the overlying shingle 32, it is to be understood that the apertures are optional. Also, other mechanisms designed to enhance the adherence of the shingle 32 to the riser 34 can be used. For example, the surface of the riser 34 can be abraded for improved adherence of the shingle adhesive, or the top surface of the riser can be provided with raised ridges for improved adherence.

In the illustrated embodiment, the adhesive is applied to the rear surface of the cap shingle 32 at the shingle manufacturing facility. In other embodiments, the adhesive can be applied to the cap shingle 32 at other desired locations, such as for example as the construction site. Optionally, additional fasteners (not shown) can be used to attach the cap shingle 32 to the installed riser 34. In some embodiments, fasteners such as for example roofing nails 66 are used to attach the non-adhesive end, or headlap end of the cap shingle 32 to the installed riser 34. In other embodiments, fasteners such as for example roofing nails can be used to attach the cap shingle 32 to the riser 32 prior to installation of the riser on the roof.

Figure 5:
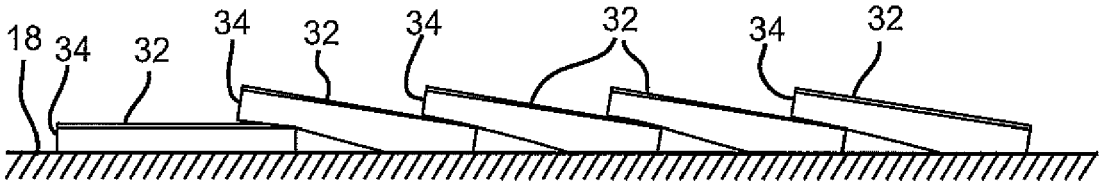
FIG. 5 is a cross-sectional view, in elevation, of a portion of a ridge having the cap shingles of FIG. 2 installed over the riser of FIG. 3 in accordance with the first embodiment of the invention.

Referring now to FIG. 5, a series of the risers 34 and the cap shingles 32 are installed in a partially overlapping sequence along the length of the ridge 18. In the illustrated embodiment, the risers 34 and the cap shingles 32 are installed such that the headlap regions of the cap shingles 32 are substantially covered by the subsequently installed risers 34. In other embodiments, the subsequently installed risers 34 can be installed such that any desired portion of the installed cap shingles 32 can be substantially covered by the subsequently installed riser 34. In other embodiments, the subsequently installed risers 34 can be mechanically interlocked with the installed risers 34. The exposure of the prime region of the cap shingle 32 can be any suitable portion of the length of the cap shingle, such as, for example, an amount within the range of from about 6 inches to about 8 inches. On the West Coast, the exposure may be greater, such as an amount within the range of from about 8 inches to about 10 inches.

Figure 6:
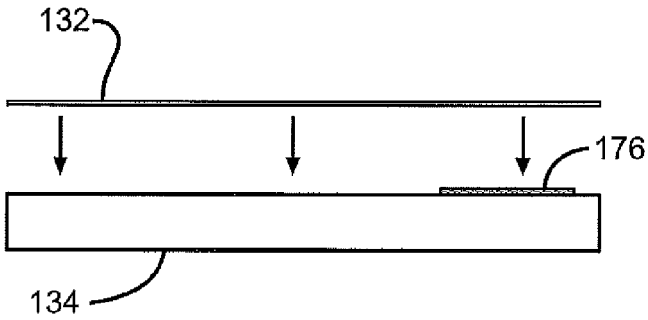
FIG. 6 is a side view, in elevation, of a second embodiment of a method of installing the cap shingle of FIG. 2 over a riser.

As discussed above, a cap shingle can be attached to the riser in other manners. Referring now to FIG. 6, a second embodiment of the method of attaching a cap shingle 132 to a riser 134 is illustrated. In the illustrated embodiment, the cap shingle 132 is the same as the cap shingle 32 described above with the exception an adhesive is not applied to the rear surface of the cap shingle 132. The riser 134 is the same as the riser 34 described above. Optionally, the riser 134 can be provided without the apertures 60 described above. In this embodiment, an adhesive structure 176 is not configured to flow through apertures in the riser 134. Rather the adhesive structure 176 is configured for placement on the surface of the riser 134 and further configured for adhesion with the rear surface of the cap shingle 132.

In the illustrated embodiment, the adhesive structure 176 is double sided tape. Alternatively, the adhesive structure 176 can be any desired substance, material or structure sufficient to attach the cap shingle 132 to the riser 134. While the illustrated embodiment is shown with the adhesive structure 176 initially applied to the riser 134, it should be understood that the adhesive structure 176 can initially be applied to the cap shingle 132. The riser 134 and the cap shingle 132 can be installed on the roof planes (not shown) as discussed above.

Figure 7:
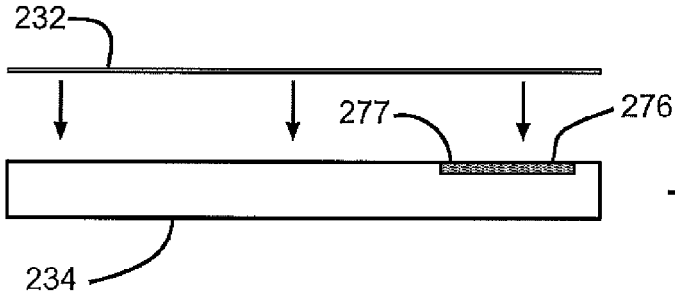
FIG. 7 is a side view, in elevation, of a third embodiment of a method of installing the cap shingle of FIG. 2 over a riser.

Referring now to FIG. 7, a third embodiment of a method of attaching a cap shingle 232 to a riser 234 is illustrated. The cap shingle 232 is the same as the cap shingle 32 described above with the exception that an adhesive is not applied to the rear surface of the cap shingle 232. The riser 234 is the same as the riser 34 described above with the exception that an adhesive structure 276 is included. The adhesive structure 276 is configured to contain an adhesive sufficient to adhere the cap shingle 232 to the riser 234. In the illustrated embodiment, the adhesive structure 276 is a channel having a rectangular cross-sectional shape and an adhesive 277 is positioned within the channel. The adhesive 277 is positioned within the channel such that the adhesive 277 contacts the cap shingle 234 as the cap shingle 234 is lowered onto the riser 234. Alternatively, the adhesive structure 276 can have any desired structure and resulting cross-sectional shape. Non-limiting examples of adhesive structures 276 include grooves, multiple grooves and channels having members extending across the channel. Non-limiting examples of cross-sectional shapes include circular cross-sectional shapes or a plurality of grooves having triangular cross-sectional shapes. The riser 234 and the cap shingle 232 can be installed on the roof planes (not shown) as discussed above.

Figure 8:
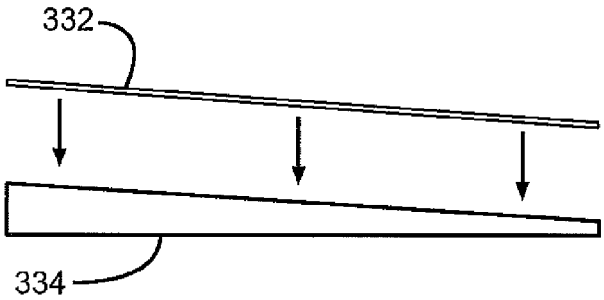
FIG. 8 is a side view, in elevation, of a fourth embodiment of a method of installing the cap shingle of FIG. 2 over a riser.
Figure 9:
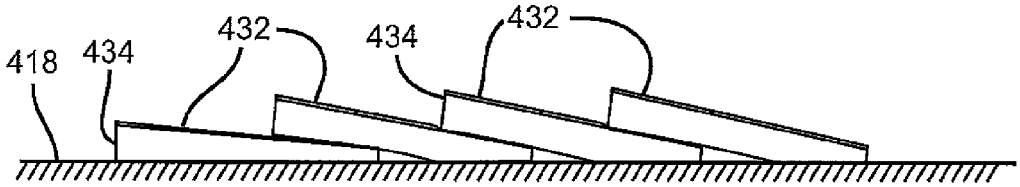
FIG. 9 is a cross-sectional view, in elevation, of a portion of a ridge having the cap shingles of FIG. 8 installed over the risers of FIG. 8.

Referring now to FIGS. 8 and 9, a fourth embodiment of a method of attaching a cap shingle 332 to a riser 334 is illustrated. The cap shingle 332 is the same as the cap shingle 32 described above. The riser 334 is the same as the riser 34 described above with the exception that the riser 334 has a sloped cross-sectional shape instead of a rectangular cross-sectional shape. The cap shingle 332 can be attached to the riser 434 in any desired manner as discussed above.

Referring now to FIG. 9, the risers 434 and the cap shingles 432 are installed in a partially overlapping sequence along the length of the ridge 418. In the illustrated embodiment, subsequent risers 434 are installed such that the headlap regions of the installed cap shingles 432 are substantially covered by the subsequently installed risers 434. In other embodiments, subsequent risers 434 can be installed such that any desired portion, such as, for example, the headlap portion, of the installed cap shingles 432 can be substantially covered by the subsequently installed risers 434.

Figure 10:
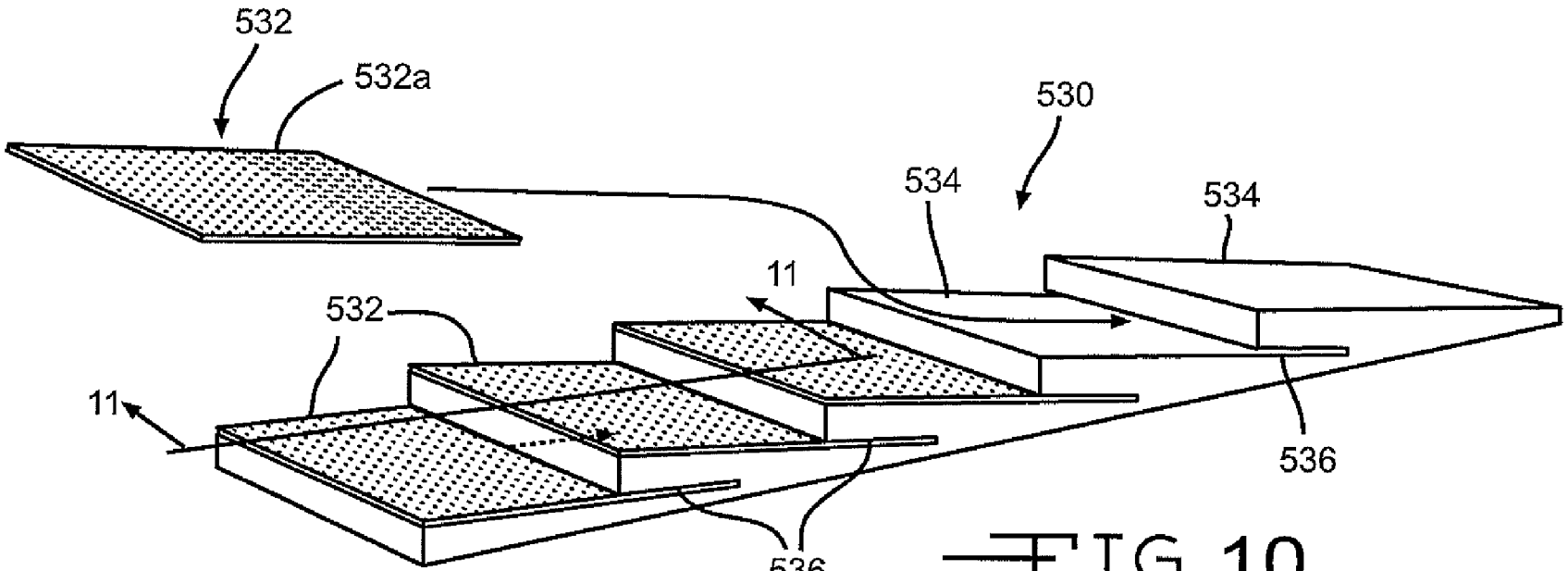
FIG. 10 is a perspective view of a ridge line roofing assembly, showing a cap shingle being installed in a slot between adjacent risers.
Figure 11:
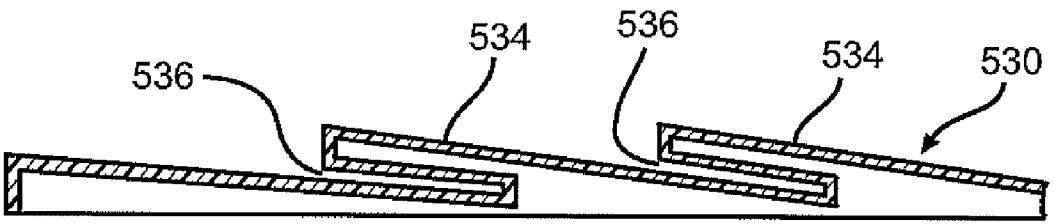
FIG. 11 is a cross-sectional view in elevation along line 11-11 of FIG. 10.

As shown in FIGS. 10 and 11, a ridge line structure roofing assembly 530 includes a series of risers 534 molded together to form the assembly including a plurality of risers. Slots 536 are formed in the molded assembly, with the slots 536 being positioned beneath the overlapping portion of the risers. The slots 536 are configured to receive the headlap portion **532*a* of cap shingles 532 into the slots. Once the cap shingle 532 has been inserted into a slot 536, a nail or other fastener can be applied to overlying riser, through the headlap portion 532*a* of the underlying shingle 532, to secure the assembly 530 and shingle 532 to the roof. As shown in FIG. 11, the slot 536 extends substantially across the width of the assembly 530. The entire assembly 536 can be flexed to enable it to conform to a ridge line structure that is defined by opposed roof planes. In other embodiments, the assembly 536 is rigid, and set at a particular angle. The ridge line structure roofing assembly 530** can be made of any suitable material, such as a polymer material or aluminum material, and can be made in any suitable manner, such as, for example by molding or by fabricating.

Figure 12:
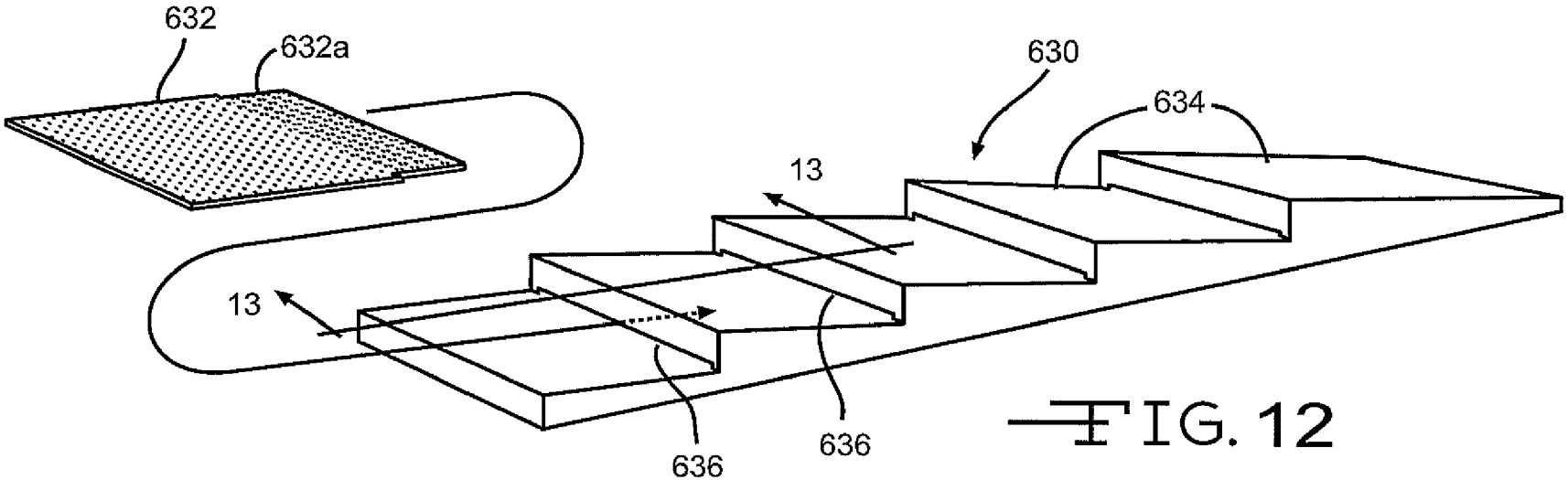
FIG. 12 is a perspective view of another embodiment of a ridge line roofing assembly.
Figure 13:
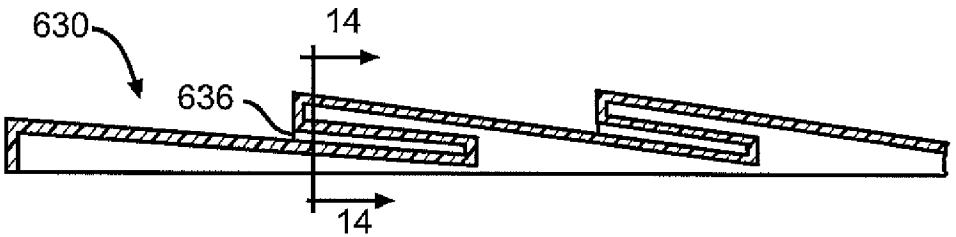
FIG. 13 is a cross-sectional view in elevation along line 13-13 of FIG. 12.
Figure 14:
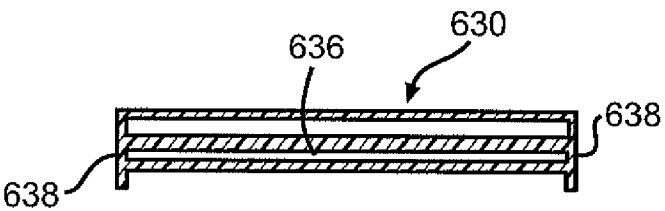
FIG. 14 is a cross-sectional view in elevation along line 14-14 of FIG. 13.

In the embodiment shown in FIGS. 12-14, the ridge line structure roofing assembly 630 is comprised of risers 634 for the receipt of shingles 632. The risers 634 are molded with slots 636 that do not extend laterally all the way across the width of the assembly 636. Instead, adjacent risers 634 in the assembly 630 are connected by side walls 638 on the outside lateral portions of the assembly 630, with the side walls 638 being spaced apart to define the slots 636 for the headlap portion of the cap shingles 632. The shingles 632 may need to be provided with slightly narrower headlap portions **632*a* to fit within the slots 636**.

The principle and mode of operation of this invention have been described in its preferred embodiments. However, it should be noted that this invention may be practiced otherwise than as specifically illustrated and described without departing from its scope.

What is claimed is:

1. A method of attaching cap shingles on a roof ridge line structure, the ridge line structure being defined by opposed roof planes, the method comprising:

forming a plurality of risers, each riser having a plurality of venting louvers formed through a broad face thereof, and extending along a longitudinal edge of the riser, each riser further having a plurality of apertures;

positioning the risers over the ridge line structure, and installing a series of the risers in a partially overlapping manner along the ridge line structure by fastening the risers to the opposed roof planes;

applying adhesive to a rear surface of each of a plurality of cap shingles; and attaching the cap shingles to the risers such that the adhesive flows through some of the apertures.

2. The method of claim 1 in which the installing of the risers and attachment of the shingles is carried out by placing a riser on the ridge line structure, placing a cap shingle on the riser, and fastening the cap shingle and the riser to the ridge line structure with a fastener.

3. The method of claim 1 in which the installing of the risers and attachment of the shingles is carried out by attaching at least one of the cap shingles to a riser, and then fastening the riser to the ridge line structure with a fastener.

4. The method of claim 1 in which the cap shingles have headlap portions and prime portions, and in which the step of installing the risers in a partially overlapping manner includes covering a headlap portion of a previously installed cap shingle.

5. The method of claim 1 in which the adhesive is applied to the cap shingles at a shingle manufacturing facility.

6. The method of claim 1 in which each riser has a sloped cross-sectional shape.

7. The method of claim 1 in which the cap shingles are positioned and attached to the risers between opposed columns of louvers.

8. The method of claim 1 in which the each riser has a rectangular shape in a plan view prior to being flexed for alignment with the opposed roof planes of the ridge line structure.

9. The method of claim 1 in which the risers are configured to be flexed for alignment with the opposed roof planes, and in which the risers are flexed before being installed on the roof, and further including flexing the cap shingles to conform to the flexed shape of the risers.

* * * * *